United States Patent [19]

Scott

[11] Patent Number: 4,982,876

[45] Date of Patent: Jan. 8, 1991

[54] CARBONATION APPARATUS

[75] Inventor: Alistair Scott, Cambridge, United Kingdom

[73] Assignee: Isoworth Limited, England

[21] Appl. No.: 229,643

[22] Filed: Aug. 8, 1988

Related U.S. Application Data

[60] Continuation-in-part of Ser. No. 85,480, Aug. 13, 1987, abandoned, which is a division of Ser. No. 946,841, Dec. 29, 1986, Pat. No. 4,726,494.

[30] Foreign Application Priority Data

Feb. 10, 1986 [GB] United Kingdom ..... 8603227
May 17, 1988 [GB] United Kingdom ..... 8811604
Jul. 11, 1988 [GB] United Kingdom ..... 8816477

[51] Int. Cl.[5] ..... B67B 5/00

[52] U.S. Cl. ..... 222/153; 222/129.1; 222/152; 222/397; 222/399; 222/400.7; 261/DIG. 7

[58] Field of Search ..... 222/129.1–129.4, 222/400.7, 394, 399, 397, 400.8, 153, 325, 152; 239/346, 369; 261/DIG. 7; 137/205; 141/59; 215/307, 274, 309, 280

[56] References Cited

U.S. PATENT DOCUMENTS

| | | | |
|---|---|---|---|
| Re. 29,850 | 11/1978 | Labarre . | |
| 2,431,596 | 11/1947 | Wickstrum | 222/400.8 |
| 3,128,918 | 4/1964 | Sandven et al. | 222/205 |
| 4,154,369 | 5/1979 | Morane . | |
| 4,293,081 | 10/1981 | Kuckens . | |
| 4,726,494 | 2/1988 | Scott | 222/152 X |

FOREIGN PATENT DOCUMENTS

| | | |
|---|---|---|
| 0080261 | 6/1983 | European Pat. Off. . |
| 226713 | 1/1987 | European Pat. Off. . |
| 0236633 | 9/1987 | European Pat. Off. . |
| 2534557 | 4/1984 | France . |
| 1588794 | 4/1981 | United Kingdom . |
| 2111961A | 12/1982 | United Kingdom . |
| 2153008 | 8/1985 | United Kingdom . |
| 2111961B | 9/1985 | United Kingdom . |

*Primary Examiner*—Andres Kashnikow
*Assistant Examiner*—Gregory L. Huson
*Attorney, Agent, or Firm*—Lerner, David, Littenberg, Krumholz & Mentlik

[57] ABSTRACT

A connector for a bottle of concentrate for a carbonating apparatus has a cylindrical body the upper end of which carries a structure defining a number of radially extending baffle and a central opening through which a dip tube may be inserted into the bottle. A latching ring for connecting the connector to the carbonation apparatus is carried by the body at a position outwardly thereof and lower than the baffle structure. The latching ring is constructed to snap on to a corresponding boss on the carbonation apparatus. The bottle is detached from the carbonation apparatus, after exhaustion of the contents, by removal of a tear-off strip which connects the latching ring to the body of the connector. To facilitate connection of a fresh bottle of concentrate to the apparatus, the apparatus includes a housing which is detachable from the remainder of the apparatus and which carries the dip tube and other elements co-operable with the connector for attaching the bottle.

30 Claims, 8 Drawing Sheets

CARBONATION APPARATUS

This is a continuation-in-part of U.S. application Ser. No. 85480 filed Aug. 13, 1987, (now abandoned) which, in turn, is a divisional of U.S. application Ser. No. 946,841 filed Dec. 29, 1986 (now issued as U.S. Pat. No. 4,726,494). The contents of said applications are incorporated herein by reference This invention relates to carbonation apparatus and to connectors and is particularly concerned with a connector for connecting a bottle of concentrated flavoring to a device, which may form part of a carbonating apparatus, for dispensing the concentrate from the bottle for mixing with carbonated water.

Our U.S. Pat. No. 4,726,494 and equivalents thereof in other countries discloses a carbonation apparatus having a concentrate dispenser which includes a metering chamber into which concentrate is drawn from a supply bottle by the action of a venturi to which carbon dioxide gas is supplied under pressure when the concentrate is to be dispensed. Gas from the venturi is passed into the concentrate bottle so that any concentrate which becomes entrained in the gas is returned to the concentrate bottle The connector for attaching the bottle to the concentrate dispenser accordingly includes a passage for receiving a dip tube through which concentrate is supplied to the metering chamber, a passage through which the gas from the venturi may enter the bottle and a passage providing a vent to atmosphere from the interior of the bottle so that the pressurised gas may escape from the bottle. A number of resilient latches are provided on the connector for securing the connector to the dispenser.

Although the arrangement described in the above U.S. patent functions excellently, the present invention aims to provide a connector of improved construction.

Important requirements for the connector are:

a. It must provide a reliable mechanical connection which is such that it does not become disconnected in use and that an adequate seal is provided between the connector and the dispenser so that concentrate is not spilled during use of the apparatus.

b. It must be easy to connect to the dispenser, particularly so that the invention may be ideal for use in the home where young children may be expected to be able to replace the bottle of concentrate after exhaustion of the supply therein.

c. For the same reason, the connector should be easily disconnectable.

d. Since home carbonation apparatus should be as compact as possible, the connector must also be compact and minimise the space required.

e. The connector should provide a stable connection i.e. the bottle of concentrate should be held relatively immovably in position.

f. The cost of manufacture should be minimised, for which purpose the connector should be such that it can be moulded at low cost from synthetic plastics material.

g. Ideally, after an empty concentrate bottle has been removed from the apparatus, it should not be reconnectable to the apparatus for reuse. This is to avoid the possibility of the bottle being refilled with unsuitable concentrate which might adversely affect the operation of the apparatus and for reasons of hygiene.

The connector of the above U.S. patent comprises a cylindrical body which is attached (essentially permanently) to the bottle containing concentrate and which has provided therein a structure which defines the above-mentioned passages and includes a baffle arrangement which prevents the carbon dioxide gas entering the bottle from directly passing to the vent to atmosphere, which would involve the risk that drops of concentrate might be discharged through the vent. Several latches are integral with the cylindrical body. These are attached to the outside of the body and project upwardly beyond the upper extremity of the cylindrical body for engagement in a cooperating groove provided in the dispenser. A dip tube and seal are provided which, although not intended to be disposable, are in the absence of a bottle not connected to the dispenser and thus there is risk of loss of these parts.

One aspect of the invention is especially concerned with reducing the cost of the connector by providing a simplified baffled arrangement so that the connector is more easily mouldable.

Another aspect of the invention is especially concerned with providing a more compact arrangement and a preferred feature of the invention for achieving this resides in a novel latch arrangement. In accordance with this feature, the latches are preferably positioned outwardly of the cylindrical body of the connector but lower than the upper extremity thereof. This not only reduces the height of the connector compared to the arrangement shown in U.S. Pat. No. 4,726,494, in which the latches project above the connector, but also, at least in a preferred form, provides the latches in such a way that theY cannot be damaged in transit.

In accordance with a further aspect, the aforementioned dip tube is substantially permanently attached to the apparatus but in a manner permitting easy insertion into the concentrate bottle.

In a further aspect, the invention provides a housing containing a chamber, preferably a metering chamber, via which concentrate may be supplied from a bottle to the carbonation apparatus for mixing with carbonated water, the housing being provided with means for connection to a bottle of concentrate and being movable relative to the carbonation apparatus, preferably being detachable therefrom, to facilitate connection of a new bottle of concentrate to the housing.

In yet a further aspect, the invention provides latch means in the form of a ring surrounding a body portion of the connector, the ring preferably being detachable for removing an empty bottle from the carbonation apparatus. Such a ring may provide a particularly stable connection.

The invention is described further by way of example with reference to the accompanying drawings in which.

Figure 1:
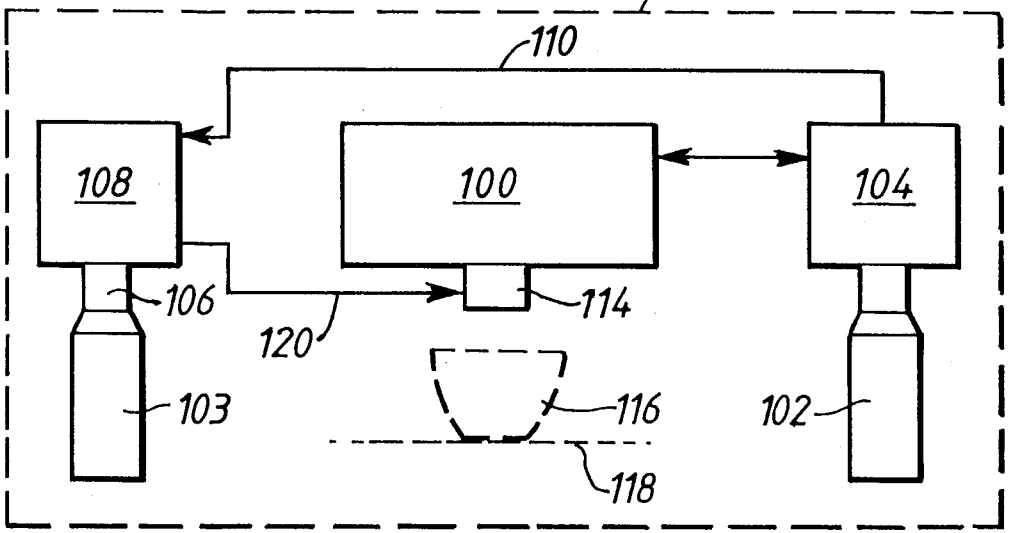
FIG. 1 is a diagrammatic representation of a carbonation apparatus in which the invention may be embodied.

With reference to FIG. 1, a carbonation apparatus for home use comprises a carbonation chamber 100 preferably of a capacity for forming a single drink at a time, for example about 6 to 16 fluid ounces. A supply of carbon dioxide is contained in a cylinder 102 which is connected to a valve arrangement 104 through which carbon dioxide may be supplied to the chamber 100 for carbonating water therein. The carbonation arrangement is preferably as described in our U.S. Pat. No. 4,719,056 and equivalents in other countries. A bottle 104 containing concentrated flavouring is connected, by a connector 106, to a concentrate dispenser 108. Carbon dioxide gas under pressure may be supplied thereto via the valve arrangement 104 and a conduit 110 for actuating the dispenser. A discharge valve 114 at the bottom of the carbonating chamber 100 is manually operable for discharging carbonated water into a drinking vessel, such as a glass 116 resting on a support 118. A conduit 120 supplies concentrate from the dispenser 108 to the discharge valve 114 for mixing with the carbonated water. The entire apparatus is contained in a suitable housing indicated very diagrammatically at 122 and is designed to be as compact as possible.

Figure 2:
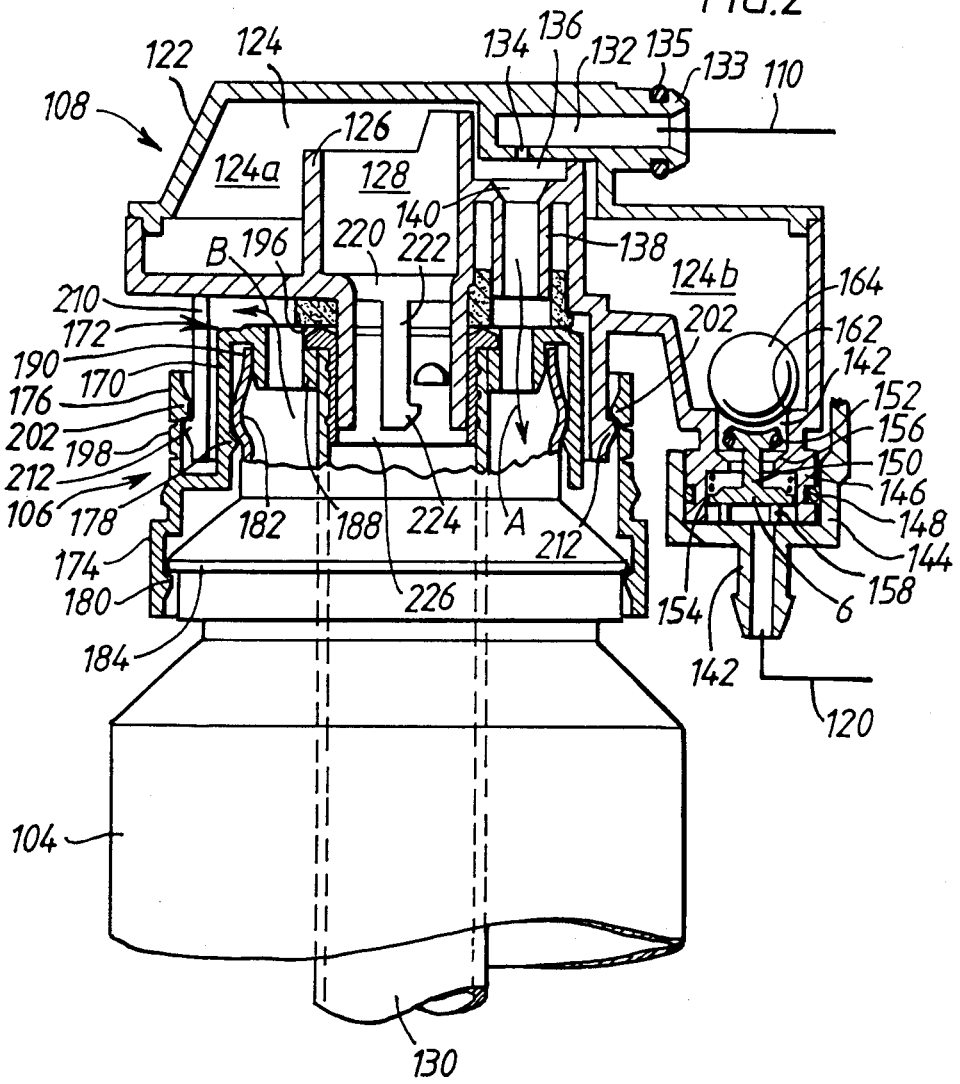
FIG. 2 is a section through part of the apparatus of FIG. 1 showing a connector according to a preferred embodiment of the invention in a position in which it is securing the concentrate bottle to a concentrate dispenser.
Figure 3:
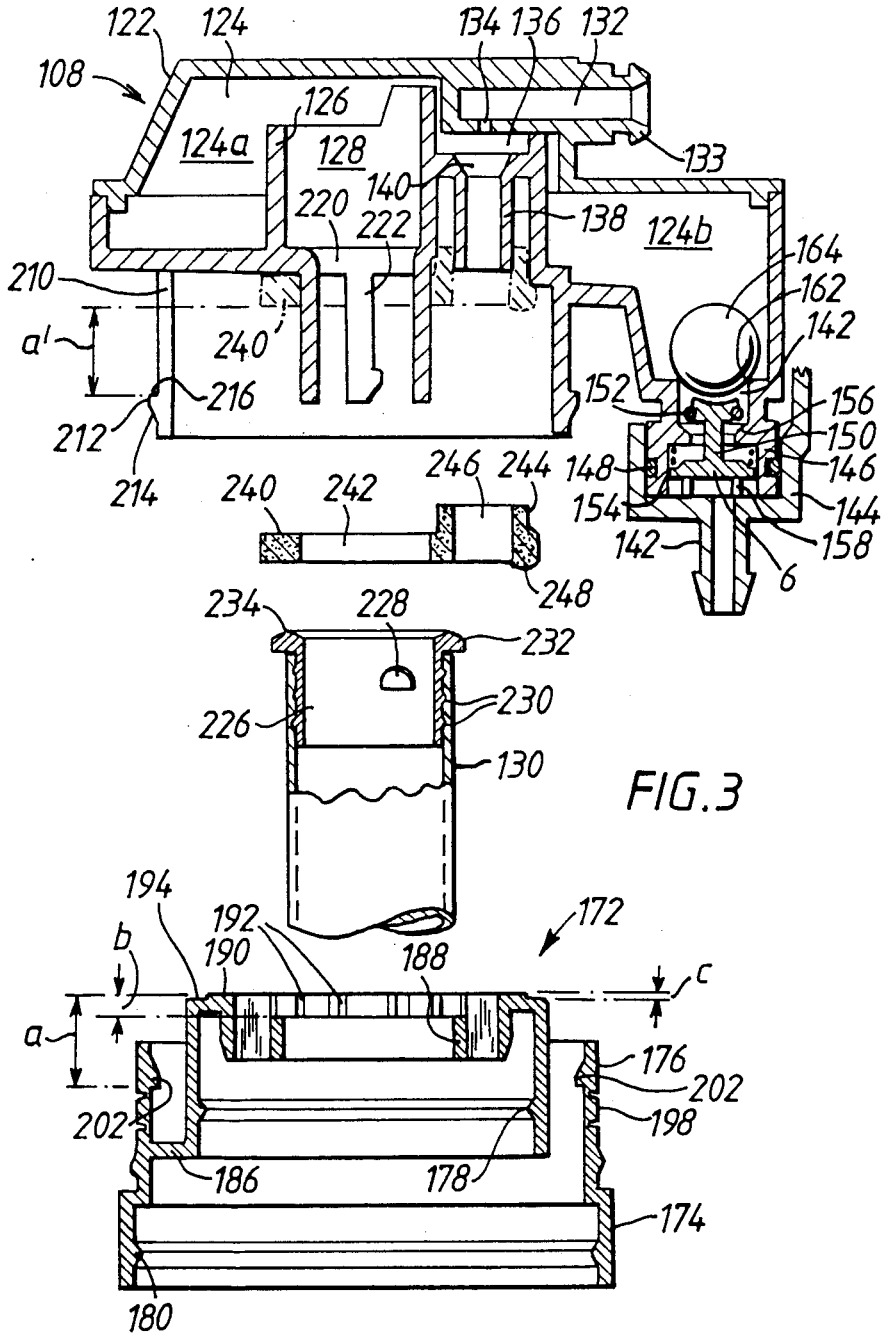
FIG. 3 is a section showing the parts of FIG. 2 separated from each other.
Figure 4:
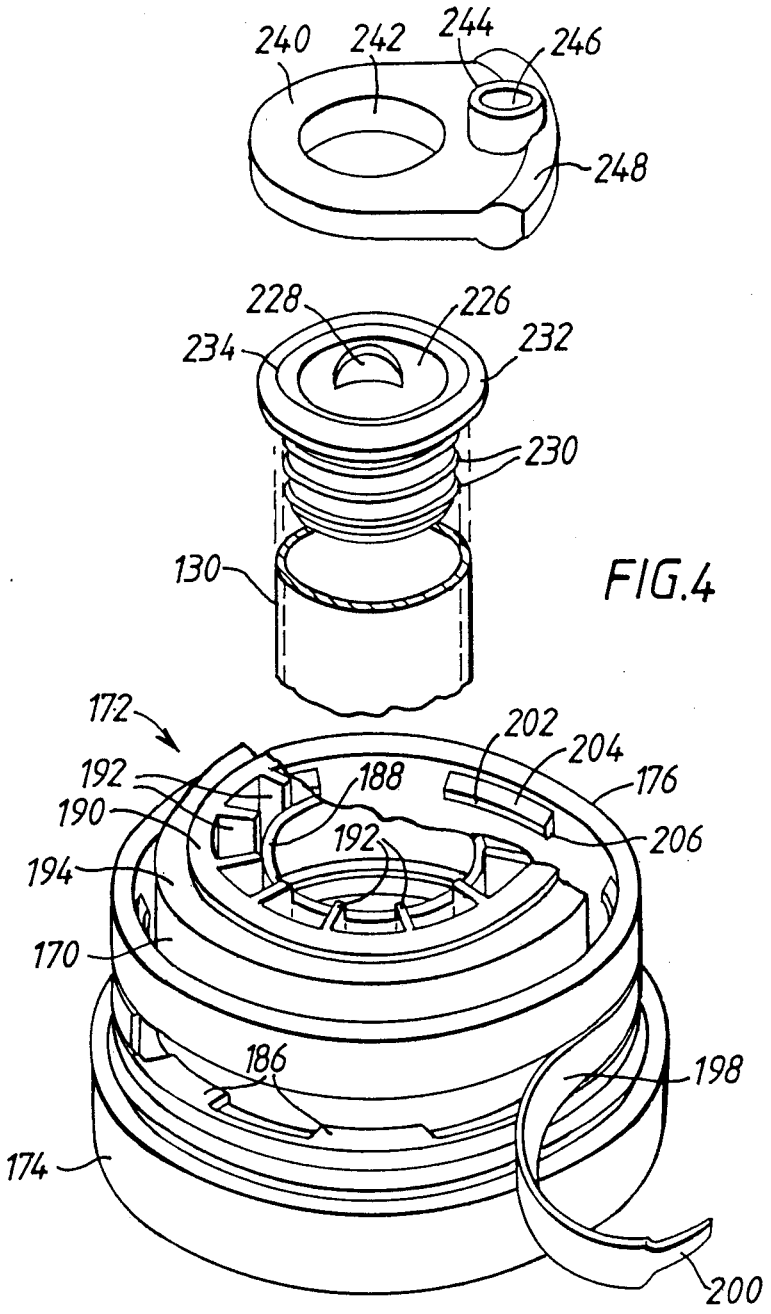
FIG. 4 is a perspective view showing some of the parts illustrated in FIG. 3, also with the parts separated from each other.

With reference to FIGS. 2 to 4, the concentrate dispenser 108 comprises a housing 122 containing a metering chamber 124 which includes a main portion **124*a* and an auxillary portion 124*b* in communication with each other. A wall 126 defines a compartment 128 which is within the chamber 124 and is in communication with the bottom of the concentrate bottle 104 via a dip tube 130 which passes through the connector 106**.

A passage 132 is connected to the conduit 110 for receiving gas therefrom and, when the dispenser 108 is operated, this gas passes through a small aperture 134, a space 136, a downwardly directed pipe 138 having an enlarged upper end 140 and through the connector 106 into the bottle 104. The gas passes through the aperture 134 at high speed so that the venturi effect reduce pressure in space 136 and therefor in chamber 124 with which space 136 is in communication. The reduced pressure draws concentrate into the chamber 124 via the dip tube 130 and compartment 128. The upper edge of wall 126 defines the maximum level of concentrate in the chamber 124 after termination of the gas supply since any concentrate above this level will be returned to the bottle 104 through the dip tube 130. Further, if the chamber 124 overfills while the gas supply is still continuing, excess concentrate will be returned to the concentrate bottle with the stream of gas through pipe 138. Thus, it may be found, from time to time, that there is some circulation of concentrate between the bottle and chamber 124 and then back into the bottle while the gas supply continues but, nevertheless, after termination of the gas supply, the correct metered amount of concentrate will be left in the chamber 124.

Concentrate supply conduit 120 is connected to a pipe 142 forming part of a hollow cylindrical member 144 which is detachably connected to a nipple 146 integral with the housing 122. An O-ring 148 on the outside of the nipple 146 forms a friction fit with the internal surface of member 144. A vertically movable valve 150 (shown in the open position) includes a seal 152 and, in the absence of the member 144, is urged downwardly by a spring 154 into a closed position in which the seal 152 engages a seat 156. Upwardly directed prongs 158 provided inside the member 144 engage a lower portion 160 of the valve 150 so as to raise, and thereby open, the valve when member 144 is connected to nipple 146. A concentrate discharge opening 162 is provided at the bottom of portion **124*b* of chamber 124 and, when chamber 124 is empty, is closed by a ball 164. When the chamber 124 contains concentrate, the ball 164 floats upwardly on the concentrate so that the chamber 124 communicates with the nipple 142 via the opening 162, the valve 156 being at this time open. The position of the valve 156 prevents residual concentrate in the chamber 124 from dripping from the dispenser 108 when the dispenser 108 is disconnected from member 144, for example to facilitate attachment of a fresh bottle 104. The floatable ball valve 164 closes immediately the chamber 124 has been emptied, during a drink forming operation, and thus ensures that the conduit 120** remains full of concentrate ready for the next drink forming operation. This facilitates ensuring that the appropriate amount of concentrate is dispensed into each carbonated drink.

The connector 106 comprises a cylindrical body 170, a baffle structure 172 at one end of the cylindrical body 170, a skirt 174 at the other end of the cylindrical body 170 and a latching ring 176, all of which are formed as a single unitary moulding of synthetic plastics material. The connector 106 is secured to the bottle 104 by means of a rib 178 formed inside the cylindrical body 170 and a rib 180 formed inside the skirt 174. The neck of the bottle is provided with an annular convex portion 182 near the upper end for engagement by the rib 178 and a flange 184 for engagement by the rib 180. The ribs 178 and 180 are so shaped that the connector can be forced on to the neck of the bottle when attaching the connector to the bottle but cannot easily be removed. Spokes 186 connect the skirt 174 to the cylindrical body 170.

The baffle structure 172 comprises inner and outer rings 188,190 and a plurality of baffled plates 192 arranged in radial planes and interconnecting the rings 188 and 190. An inwardly directed flange 194 at the upper end of body 170 supports the outer ring 190 which, in turn, supports the baffles 192 which, again in turn, support the inner ring 188. The axial extent of the baffle plates 192 is equal to that of the outer ring 190. The lower extremities of the rings 188 and 190 are in the same radial plane but the ring 188 is shorter (in the axial direction) than the ring 190 so that a circular recess 196 is defined by the upper extremity of the inner ring 188 and the inner extremities of the baffle plates 192.

The latching ring 176 is connected to the cylindrical body 170 via a tear-off ring 198 and the spokes 186. The ring 198 is provided with a tab 200 which may be gripped between finger and thumb when the ring 198 is to be torn off. A number of inwardly directed projections 202 having downwardly inclined upper surfaces 204 and radial lower surfaces 206 are formed inside the latching ring 176.

The dispenser 108 is provided with a downwardly directed cylindrical boss 208 having an axial slot 210 and an outwardly directed projection 212 near its lower end. The projection 212 forms a complete annulus apart from the discontinuity at slot 210. The lower surface 214 of projection 212 is inclined and the upper surface 216 is radial.

In order to attach a fresh bottle of concentrate to the dispenser 108, the cylindrical body 170 of the connector is inserted into the hollow boss 208 which thereby enters the space between cylindrical body 170 and latching ring 176. The afore-described shape of the projections 202 and 214 ensures that projection 202 may slide over projection 214, the boss 208 and ring 176 being sufficiently resilient to accommodate this, until the connector 106 becomes locked to the boss 208 by the interengagement of surfaces 206 and 216. The bottle can thereafter only be removed (other than with exceptional difficulty) by tearing off the strip 198 so that the latching ring 176 becomes separated from the remainder of the connector 106. After the connector has been removed from the boss 208, the detached ring 176 may be easily distorted in shape to enable it to be removed without difficulty from the boss 208.

Figure 5:
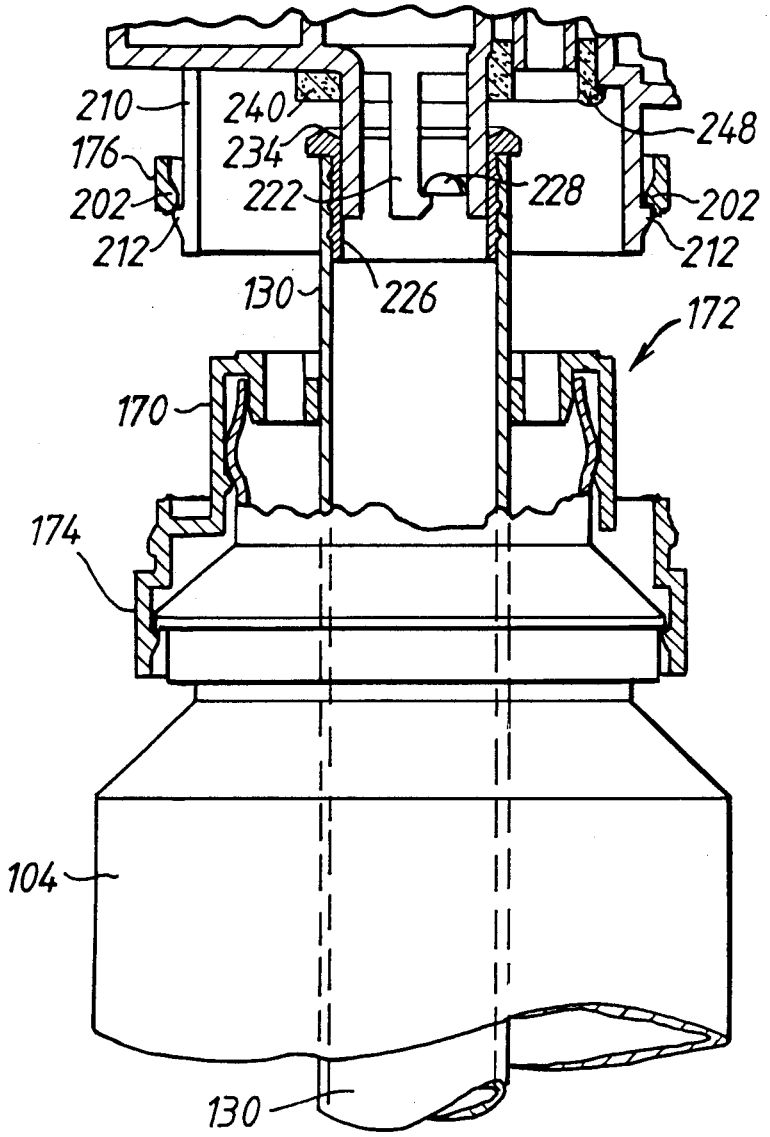
FIG. 5 is a partial section showing the concentrate bottle being separated from the dispenser after exhaustion of the supply of concentrate.

The compartment 128 of dispenser 108 communicates with dip tube 130 via an aperture 220. Four downwardly directed prongs 222 integral with the housing 122 are distributed around the aperture 220 at spaced apart positions and have hooks 224 at their lower ends. A cylindrical collar 226 loosely surrounds the prongs 222 and is provided with four inwardly directed projections 228 which limit the downward movement of the collar 226 relative to the prongs 222, as shown in FIG. 5, in the absence of the connector 106. The collar 226 is secured inside the upper end of the dip tube 130 by ribs 230 and, at its upper end, is provided with an outwardly directed flange 232 the upper surface of which has an annular ridge 234.

A solid elastomeric seal 240 is carried by the dispenser 108 underneath the housing 122 and has a central opening 242 in which the prongs 222 are received and an eccentrically positioned nipple 244 having an opening 246 therethrough which tightly receives the lower end of pipe 138 to form a seal therewith. Edge 248 of seal 240 is enlarged.

Figure 6:
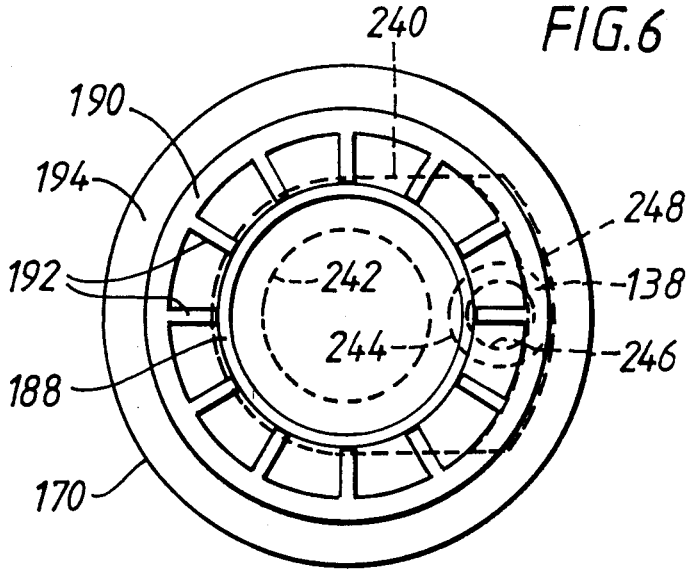
FIG. 6 illustrates part of the connector showing the relationship between the connector and the sealing member.

The bottles 104 of concentrate are supplied with a cover which closes the upper end of the connector 106 until the bottle is to be connected to the dispenser 108 for use. Such cover may, for example, comprise an aluminium foil closure adhered to the upper surface of flange 194 and/or the upper surface of ring 190. When the bottle is to be attached to the dispenser, the cover is first removed, and the dip tube 130 is then inserted into the bottle through the ring 188. Initially, the dip tube 130 and collar 230 will be in the position shown in FIG. 5 but, as the body 170 is inserted fully into the boss 208, the flange 232 of sleeve 230 will locate in the recess defined by the upper surface of ring 188 and the inner edges of baffles 192 and will be supported by the upper surface of ring 188. As the connector 106 is pushed fully home and the latching ring 176 engages the projection 214, the ridge 234 on flange 232 will be pushed into the elastomeric member 240 in order to form an air-tight seal between the dip tube 130 and the body 122. Also, the enlarged edge portion 248 of the member 240 forms an airtight seal with the portion of the upper surface of flange 194 engaged thereby. Further, the upper extremities of those baffle plates 192 which engage the under surface of member 240 at the right hand side thereof as seen in the drawings (i.e. in the region of nipple 244), also form a seal with the member 240. Thus, as indicated by arrow A in FIG. 2, gas from the pipe 138 passes through the nipple 244 and one or more of the spaces between baffles 192 at the right hand side of the structure as seen in FIG. 2 and into the bottle 104. As further seen in FIG. 2, and as will be appreciated from consideration of FIG. 6 showing the relationship between the seal 240 and the baffle structure, the spaces between the majority of the baffles 192 vent the interior of the bottle 104 to atmosphere via the interior of boss 208 and the slot 210 therein. Further, FIG. 6 also shows that gas from the pipe 246 is delivered into the spaces between one or more of the baffles regardless of the rotational position of the connector relative to the pipe 138. By virtue of the cooperation between the seal 240 and the baffles 192, the radial baffles 192 ensure that the gas entering the connector 106 from pipe 138 cannot circulate circumferentially and is thus forced to enter the upper portion of the bottle 104 before it can be exhausted to atmosphere for example along the route shown by arrow B in FIG. 2. This ensures that concentrate entrained in the gas entering the connector 106 from the pipe 138 returns to the body of concentrate in the bottle without being ejected from the apparatus.

In order to ensure that the required seals are created when the connector 106 is attached to the dispenser 108, the dimension a between surface 206 of projection 202 and the upper surfaces of ring 190 and flange 194 should be properly related to the dimensions of the dispenser. Thus, as shown in FIG. 3, dimension a might be $11^{\pm 1}$ mm and dimension a1 should be slightly less than dimension a. Dimension b, which is the distance between the upper surfaces of rings 188 and 190 (i.e. the depth of the recess which receives flange 232) is preferably 1.8 mm approximately. The dimension c, which is the distance between the upper surface of ring 190 and the upper surface of flange 194 is preferably 0.5 mm and is related to the size of the enlargement 248 of member 240.

Figure 7:
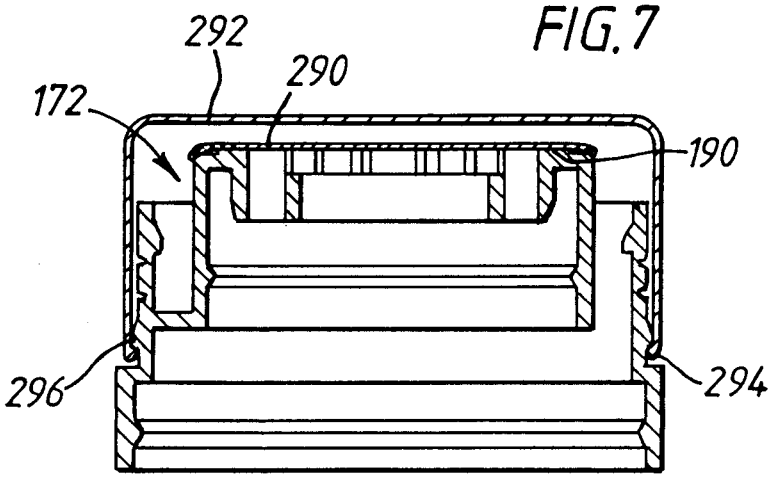
FIG. 7 shows the connector in combination with a seal cover and a cap, before use of the bottle.

When the full concentrate bottle is supplied, it is necessary to provide a cover preventing the liquid being spilled. Thus, in FIG. 7, a cover 290 is shown bonded to the top surface of the connector, the bonding preferably being with the surface 190. Further, a cup-shaped cap 292 of resilient synthetic plastics material is also provided and this has a snap-on projection 294 which engages with a cooperating projection 296 on the connector. The cap 302 protects the cover 300, which may be of relatively delicate material such as aluminium foil, from damage in transit and the ability to easily provide such a cap is an advantage of the preferred embodiment of the invention.

The preferred embodiment of connector 106 as illustrated in the drawings and described in detail meets all of the requirements set out above. Particularly, the arrangement of the latch 176 at a position spaced outwardly of but below the upper extremity of the cylindrical body 170 provides for compactness and the structure is connectable and disconnectable, in the manner described, with great ease. The required reliability is provided and low cost is achieved since the structure shown can be easily moulded as a single unit from synthetic plastics material. The provision of the latches 204 on a ring ensures great stability when the concentrate bottle is connected to the carbonation apparatus and this ring cannot accidentally be broken off during to dropping the bottle before use. A simple snap-on connection to the apparatus is achieved. The need to detach ring 176 by tearing off strip 198 in order to remove the used bottle ensures that the bottle cannot be reused and thus substantially eliminates the risk that the carbonating apparatus could be rendered inoperable by using an unsuitable concentrate, for example a concentrate which was too viscous.

Figure 8:
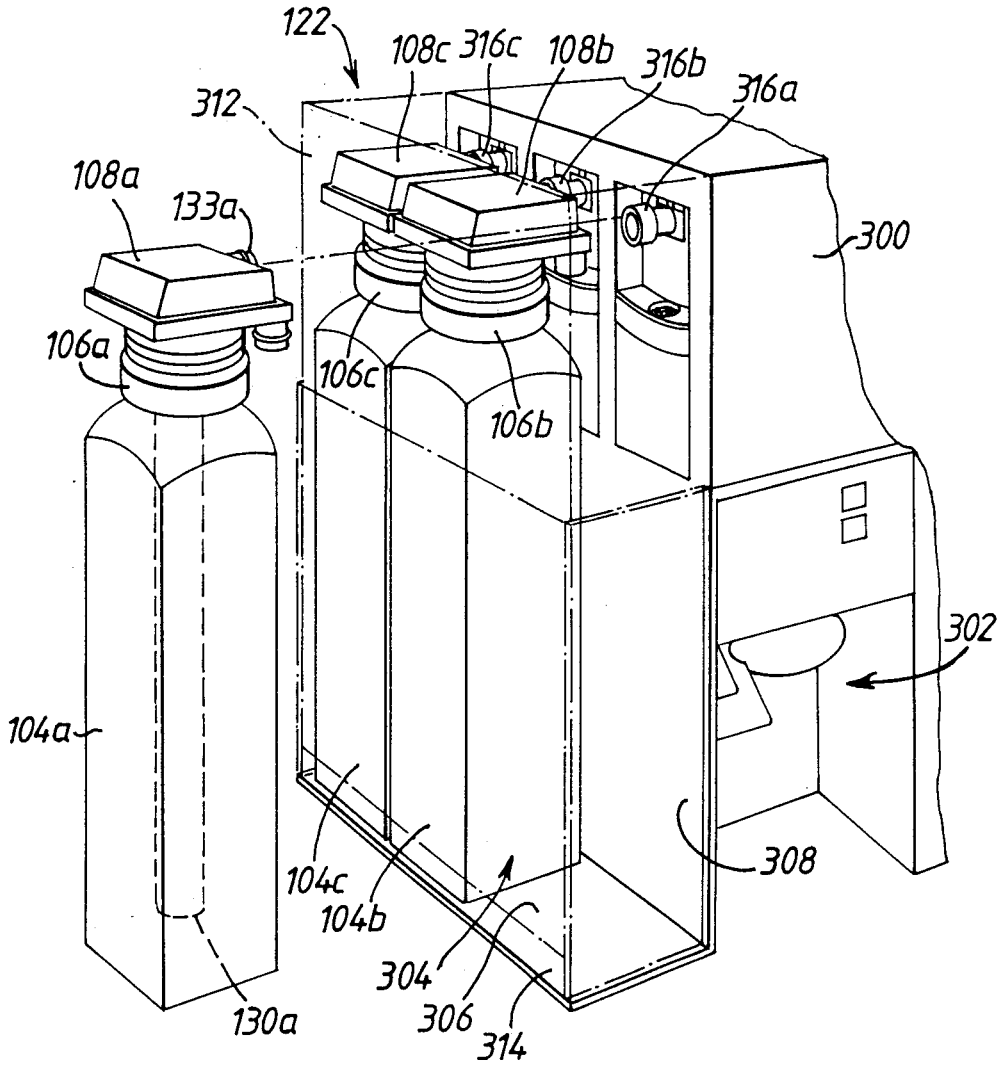
FIG. 8 is a perspective view of part of a carbonation apparatus according to a preferred embodiment of the invention.

With reference to FIG. 8, the housing 122 of the machine, which housing is shown only diagrammatically in FIG. 1, includes a main portion 300 containing the carbonation chamber (not shown) and defining a cavity 302 for receiving a glass or other drinking vessel and in the upper portion of which the discharge valve arrangement 114 is located. A compartment 304 is provided on the left-hand side of the housing 122 as seen in FIG. 8 for containing three bottles of concentrate, each containing concentrate of respectively different flavour, labelled 104*a*, 104*b* and 104*c*. The compartment 304 is defined by a base 306, a back wall 308, side walls 310, a removable cover 312 and a low front wall 314. For clarity, the walls 310, cover 312 and front wall 314 are illustrated only in broken lines The compartment 304 also contains three dispensers 108*a*, 108*b* and 108*c* and each is connected to a respective one of the bottles of concentrate by connector 106*a*, 106*b* and 106*c* respectively, which connectors are secured to the bottles. The bottles 104*a, b, c,* connectors 106*a, b, c* and dispensers 108*a, b, c* are all as described with reference to FIGS. 1 to 7, these parts being designated by the same reference numbers with the addition of a, b and c to indicate the different items in FIG. 8. A further compartment (not shown) for the carbon dioxide supply cylinder may be provided at the other side of the housing 122.

Figure 9:
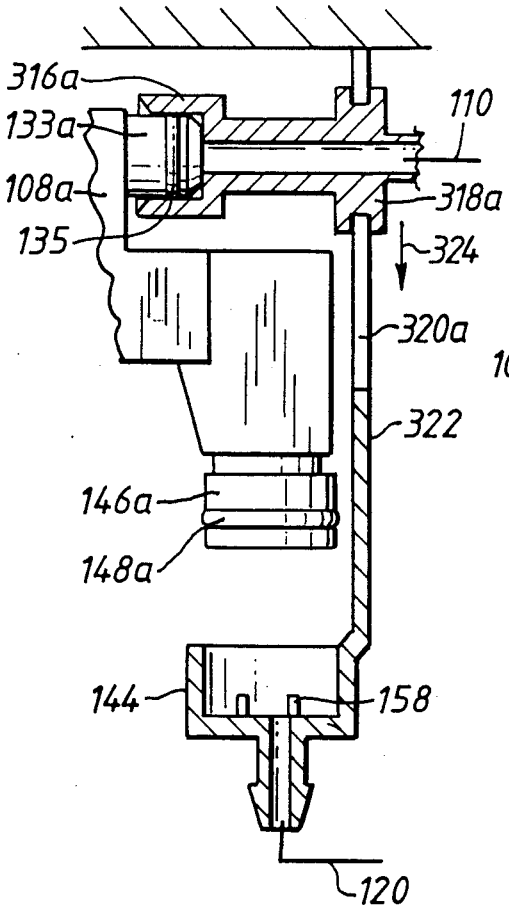
FIG. 9 is a section through part of the apparatus shown in FIG. 8.
Figure 10:
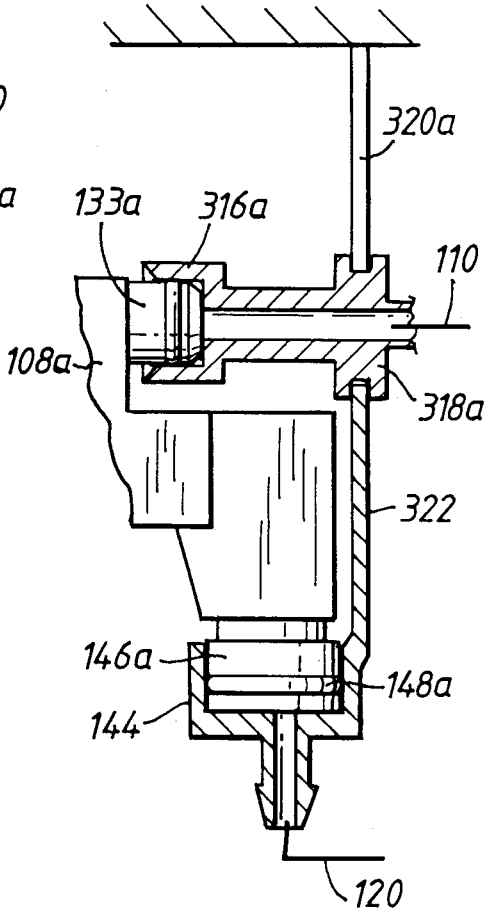
FIG. 10 is a section similar to FIG. 9 but showing the parts in a different position.

It will be recalled from earlier description that the dip tube 130 remains attached to the dispenser 108*a* during attachment and detachment of concentrate bottles. In order that the compartment 304 may be made as compact as possible, the dispensers 108*a, b* and *c* are all detachable from the carbonation apparatus so that the connection between the connector 106 and dispenser 108 may be easily made, and the dip tube 130 inserted into the bottle, whilst the dispenser 108 is detached, thus avoiding the need for providing sufficient space in the compartment 304 for this to take place with the dispenser 108 in situ. Thus, FIG. 8 shows dispenser 108*a* detached from the apparatus and removed from the compartment 304 so that a fresh bottle of concentrate 104*a* may be fitted. After fitting the fresh bottle 104*a*, the dispenser 108*a* is reattached by firstly inserting nipple 133*a* into hollow cylindrical gas connector housing 316*a*, as shown in FIG. 9, so that O-ring 135 forms a substantially gas tight seal. In this way, passage 132 is connected to gas conduit 110. Housing 316*a* is carried by a slide member 318*a* which is slidably mounted in a slot 320*a* in a wall 322 of housing 122 so that the slide 318*a* may be vertically moved. After nipple 133*a* has been inserted into housing 316*a*, with the slide 318*a* in the upper position, slide 318*a* is moved downwardly as shown by the arrow 324 until the position shown in FIG. 10 is reached in which the nipple 146*a* is fully inserted into the member 144 so that the valve member 150 is moved to the open position by engagement with the elements 158. In the position shown in FIG. 10, the apparatus may be operated in the manner previously described in which the required amount of concentrate for a single drink is drawn into the metering chamber 124 by the Venturi effect of gas exiting from the aperture 134 and, upon operation of the valve 114, is supplied from the chamber 124 to the drinking vessel via the conduit 120.

When the concentrate in one of the bottles has been exhausted, the corresponding dispenser 108*a* may be raised from the position shown in FIG. 10 to that shown in FIG. 9, thereby disconnecting the nipple 146 from housing 144, and thereafter the dispenser may be moved horizontally to the left as shown in FIGS. 8, 9 and 10 to disconnect the nipple 133 from the housing 216. The exhausted bottle 106 may then be removed by removing tear-off strip 198 from connector 106, the ring 176 then removed from boss 210, and a fresh bottle of concentrate connected to dispenser 108.

Various modifications are possible within the scope of the invention. For example, although the dispenser 108 has been shown as containing a Venturi pump, other means may be provided for causing the concentrate to move from the bottle to the dispensing chamber. It is particularly preferred, however, that a gas driven pump, preferably a Venturi pump, should be used.

I claim:

1. A bottle having upper and lower portions, the bottle containing concentrate for flavouring a carbonated drink in said lower portion and having a gas space in said upper portion, the bottle comprising:

structure defining a concentrate outlet, a concentrate and gas return inlet and a gas outlet remote from said concentrate and gas return inlet; and securement means for attaching the bottle to carbonating apparatus of the type having a concentrate inlet and a gas and concentrate return so that the concentrate inlet of the carbonating apparatus is connected to said lower portion through said concentrate outlet, the gas and concentrate return of the carbonating apparatus is connected to said gas space through said concentrate and gas return inlet and said gas space is vented to the atmosphere through said gas outlet, said securement means comprising inwardly directed latch means disposed outwardly of said structure and at a position below an upper extremity thereof.

2. A bottle containing concentrate for flavoring a carbonated drink, the bottle having a concentrate outlet, a concentrate and gas return inlet and a gas outlet and means for separating concentrate from a mixture of gas and concentrate entering said bottle via said concentrate and gas return inlet, passing concentrate separated from said mixture into the concentrate contained in the bottle and discharging gas separated from said mixture through said gas outlet.

3. A connector for connecting a bottle of concentrate to a concentrate dispenser of a carbonation apparatus, comprising:

a body portion connected or adapted to be connected to the upper end of a bottle;

latch means for engaging the carbonation apparatus carried by said body and disposed below said upper end thereof and spaced outwardly of said body, structure carried by said body adjacent the upper end thereof and defining a central opening through which a dip tube may be inserted into said bottle, said structure including an inner ring defining said opening for said dip tube, an outer ring connected to said body and baffle plate means interconnecting said inner and outer rings and defining passageways through which gas may pass into and out of the bottle, said baffle plate means comprising baffle plates in axially extending radial planes.

4. A connector according to claim 3, wherein said structure is such that gas may pass therethrough by movement axially thereof without deflection whilst within said structure.

5. A connector for connecting a bottle of concentrate to a concentrate dispenser of a carbonation apparatus comprising:

(a) a body portion having an upper and a lower end;

(b) means for connecting said body portion to a bottle of concentrate so that said body portion cannot be readily removed from the body portion;

(c) means defining a frangible element; and (d) latch means for engaging the carbonation apparatus while said frangible element is unbroken, said latch means being substantially resistant to disengagement from the concentrate dispenser except upon rupture of said frangible element, said latch means and said frangible element being constructed and arranged so that said latch means are permanently disable upon rupture of said frangible element, whereby the bottle can be attached to the carbonation apparatus without breaking said frangible element but cannot be removed from the carbonation apparatus except by breaking said frangible element and permanently disabling the connector.

6. A connector as claimed in claim 5 wherein said latch means includes a flexible element and a projection on said flexible element for engaging the carbonation apparatus, said flexible element being connected to said body portion through said frangible element so that upon breakage of said frangible element said flexible element is released from said body portion, whereby said flexible element may be more readily flexed after breakage of said frangible element.

7. A connector as claimed in claim 5 wherein said flexible element is a ring, said at least one projection including a plurality of projections spaced around the circumference of said ring.

8. A connector for connecting a bottle of concentrate to a concentrate dispenser of a carbonation apparatus comprising:

(a) a body portion having upper and lower ends;

(b) means for connecting said body portion to a bottle of concentrate;

(c) a latch support member connected to said body below said upper end thereof and extending upwardly from such connection towards the upper end of said body, at least an upper portion of said latch support member above said connection being spaced outwardly of said body so that there is a gap between said upper portion of said latch support member and said body; and (d) at least one projection extending inwardly from said upper portion of said latch support member into said gap, each said projection being adapted to engage a mating feature of the concentrate dispenser so as to secure the connector to the concentrate dispenser.

9. A connector as claimed in claim 8 wherein said latch support member is arcuate and extends at least partially around said body portion.

10. A connector as claimed in claim 8 wherein said latch support member includes a frangible portion disposed below said at least one projection but above the connection between said latch support member and said body portion, whereby said at least one projection can be separated form said body portion by breaking said frangible portion of said latch support member.

11. A connector as claimed in claim 8 wherein said latch support member is tubular and surrounds said body portion.

12. A connector as claimed in claim 11 wherein said at least one projection includes a plurality of projections spaced apart from one another around the circumference of said tubular latch support member.

13. A connector as claimed in claim 12 wherein said tubular latch support member includes at least one frangible portion extending around it circumference below said projections but above the connection between the latch support member and the body portion whereby said projections may be separated from said body portion by breaking said frangible portion.

14. A connector as claimed in claim 13 wherein said latch support member includes two said frangible portions extending circumferentially around the tubular latch support member, said two frangible portions being spaced apart from one another and defining a tear strip therebetween below said projections.

15. A bottle having upper and lower portions, the bottle containing concentrate for flavoring a carbonated drink in said lower portion and having a gas space in said upper portion, the bottle comprising:

structure defining a concentrate outlet, a concentrate and gas return inlet an da gas outlet remote from said concentrate and gas return inlet; and securement means for attaching the bottle to carbonating apparatus of the type having a concentrate inlet and a gas and concentrate return so that the concentrate inlet of the carbonating apparatus is connected to said lower portion through said concentrate outlet, the gas and concentrate return of the carbonating apparatus is connected to said gas space through said concentrate and gas return inlet and said gas space is vented to the atmosphere through said gas outlet.

16. A bottle as claimed in claim 15 further further comprising a connector having:

a body portion connected to said upper portion; and latching means for engaging the carbonation apparatus carried by said body and disposed below said upper and thereof and spaced outwardly of said body, said securement means including said latch means.

17. A bottle according to claim 16, wherein said latching means is provided with inwardly directed projections.

18. A bottle according to claim 17, wherein said latching means comprises a latching ring on which said projections are formed.

19. A bottle according to claim 18, wherein said latching ring is connected to said body through a tear-off strip.

20. A bottle according to claim 16, including structure carried by said body adjacent the upper end thereof and defining a central opening through which a dip tube may be inserted into said bottle, said central opening constituting said concentrate outlet.

21. A bottle according to claim 20, wherein said structure comprises an inner ring defining said opening for said dip tube, an outer ring connected to said body and baffle plate means interconnecting said inner and outer rings and defining passageways through which gas may pass into and out of the bottle, said passageways constituting said concentrate and gas return inlet and said gas outlet,

22. A bottle according to claim 21, wherein said baffle plate means comprises baffle plates in axially extending radial plane.

23. A bottle according to claim 2, wherein said structure is such that gas may pass therethrough by movement axially thereof without deflection whilst within said structure.

24. A bottle as claimed in claim 15 wherein said upper portion includes a neck, and wherein said concentrate outlet is disposed substantially centrally relative to said neck.

25. A bottle according to claim 15 wherein said securement means comprises a latching device extending upwardly beyond said structure.

26. A bottle as claimed in claim 15 wherein said concentrate outlet is disposed in said upper portion, said securement means being operative to attach the bottle to the carbonating apparatus so that a dip tube on the carbonating apparatus is received in the concentrate outlet of the bottle.

27. A bottle according to claim 26 wherein said concentrate and gas return inlet and said gas outlet are disposed in said upper portion of said bottle on opposite sides of said concentrate outlet.

28. A bottle, as claimed in claim 23, further comprising a connector for connecting the bottle to an associated carbonating apparatus for supplying the concentrate thereto, the connector comprising;

a generally cylindrical body attached to said upper portion;

a plurality of radially extending members attached to said generally cylindrical body and extending inwardly thereof such that a substantially central aperture is defined adjacent the inner ends of said radially extending members and a plurality of further apertures are defined between said radially extending members, said central aperture constituting said concentrate outlet, said plurality of further apertures constituting said concentrate and gas return inlet and said gas outlet; and a latching arrangement for attaching the connector to the carbonating apparatus, said securement means including said latching arrangement.

29. A bottle according to claim 28, including a ring element secured to said radially extending members at the inner ends thereof to define said substantially central aperture.

30. A bottle according to claim 29 wherein said ring element is positioned at a level lower than the upper extremity of said cylindrical body.

* * * * *

UNITED STATES PATENT AND TRADEMARK OFFICE

CERTIFICATE OF CORRECTION

PATENT NO. : 4,982,876

DATED : January 8, 1991

INVENTOR(S) : Alistair Scott

It is certified that error appears in the above-identified patent and that said Letters Patent is hereby corrected as shown below:

Column 2, line 31, "theY" shoudl read --they--.

Column 10, line 31, "an da" should read --and a--.

Column 11, line 9, "claim 2" should read --claim 22--.

Column 12, line 3, "claim 23" should read --claim 15--.

Signed and Sealed this

Tenth Day of November, 1992

*Attest:*

DOUGLAS B. COMER

*Attesting Officer*

*Acting Commissioner of Patents and Trademarks*